US006279895B1

(12) United States Patent
Tranquilla

(10) Patent No.: US 6,279,895 B1
(45) Date of Patent: Aug. 28, 2001

(54) FEEDER WITH LARGE PSEUDO-RADIUS

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/061,111

(22) Filed: Apr. 16, 1998

Related U.S. Application Data

(60) Provisional application No. 60/063,076, filed on Oct. 27, 1997.

(51) Int. Cl.[7] ..... B65H 3/04
(52) U.S. Cl. ..... 271/35; 271/121; 271/122
(58) Field of Search ..... 271/34, 35, 122, 271/125, 121

(56) References Cited

U.S. PATENT DOCUMENTS

| | | | | |
|---|---|---|---|---|
| 2,635,874 | | 4/1953 | La Bore | 271/35 |
| 3,198,514 | * | 8/1965 | Barbera et al. | 271/34 |
| 4,020,972 | * | 5/1977 | Lundblad | 271/35 |
| 4,324,395 | * | 4/1982 | Silverberg | 271/35 |
| 4,934,685 | * | 6/1990 | Shifley | 271/35 |
| 4,991,831 | * | 2/1991 | Green | 271/121 |
| 5,110,107 | * | 5/1992 | Bieber | 271/35 |
| 5,150,891 | | 9/1992 | Svyatsky et al. | 271/35 |
| 5,211,388 | * | 5/1993 | Walluk | 271/122 |
| 5,238,236 | | 8/1993 | Belec et al. | 271/34 |
| 5,431,385 | * | 7/1995 | Holbrook | 271/122 |
| 5,435,537 | * | 7/1995 | Gysling | 271/122 |
| 5,531,432 | | 7/1996 | Sardella | 271/10.01 |
| 5,711,518 | * | 1/1998 | Portaro et al. | 271/10.11 |
| 6,029,971 | * | 2/2000 | Lynch et al. | 271/34 |

* cited by examiner

*Primary Examiner*—H. Grant Skaggs
(74) *Attorney, Agent, or Firm*—David G. Rasmussen; Mark T. Starr

(57) ABSTRACT

A document feed arrangement has a nip between a feeder and a separator where documents in a stack are urged, singly into the nip and advanced therebeyond by the feeder. A continuously rotating nudger urges the documents into the nip. The nudger has an open space separation from the nip and feeder. In addition, the nudger is disposed adjacent the end document in the stack and arranged to periodically thrust the end document across the separation into the nip. As soon as the end document leaves the nudger it immediately contacts the next-to-the-end document in the stack and begins to thrust it forward. The feeder surface is defined by a large radius at the point of the nip so that the surface of the feeder bends away from the nip. The feeder advances the end document from the stack through the nip without simultaneously advancing a second document. The separator surface is defined by a smaller radius than the feeder for restraining the remaining documents of the stack.

27 Claims, 7 Drawing Sheets

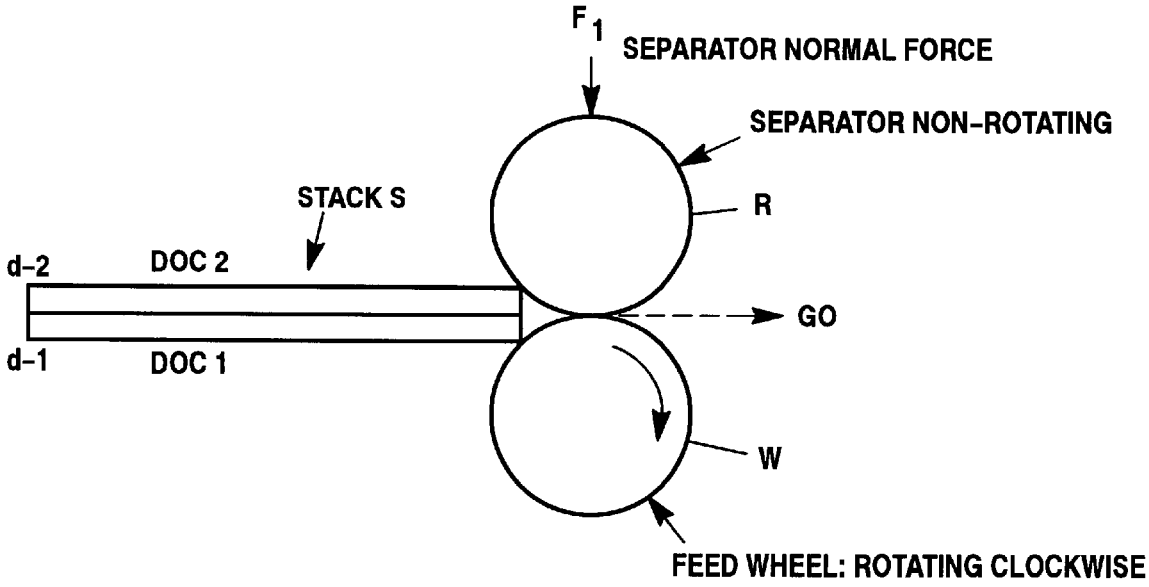
*Figure A1*
*MODEL OF TWO DOCUMENTS ENTERING NIP*

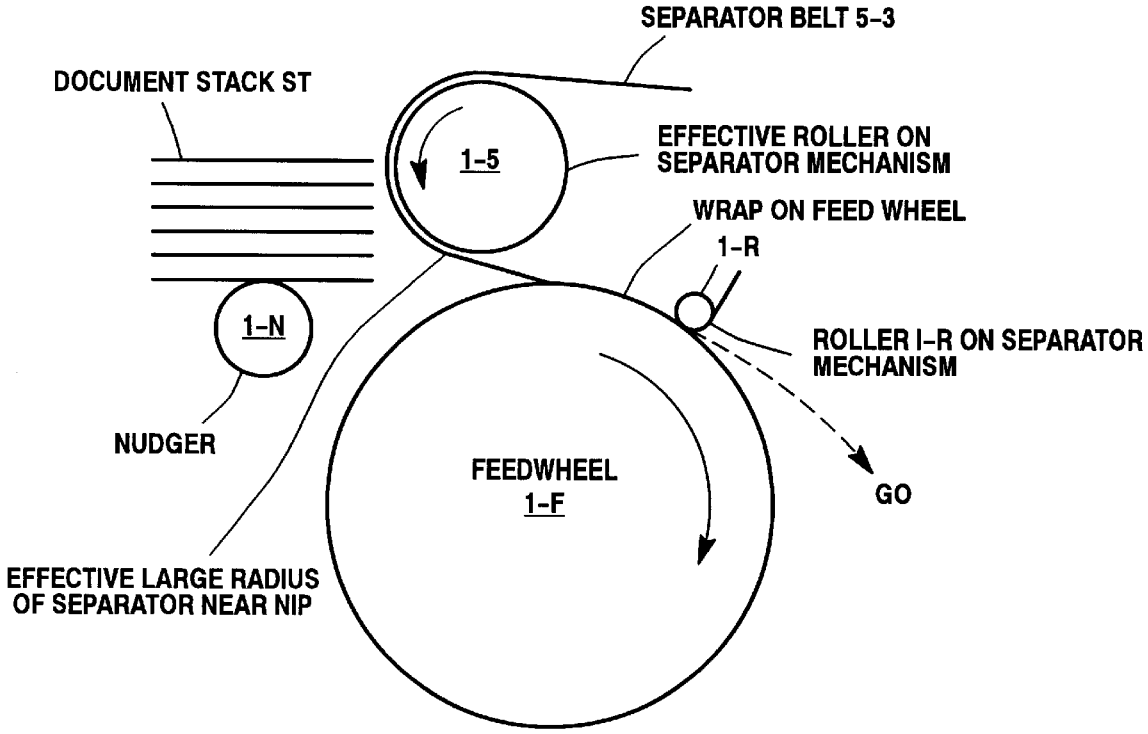
*Figure A2*
*HIGH SPEED FEEDER FEEDWHEEL & SEPARATOR RELATIONSHIP*

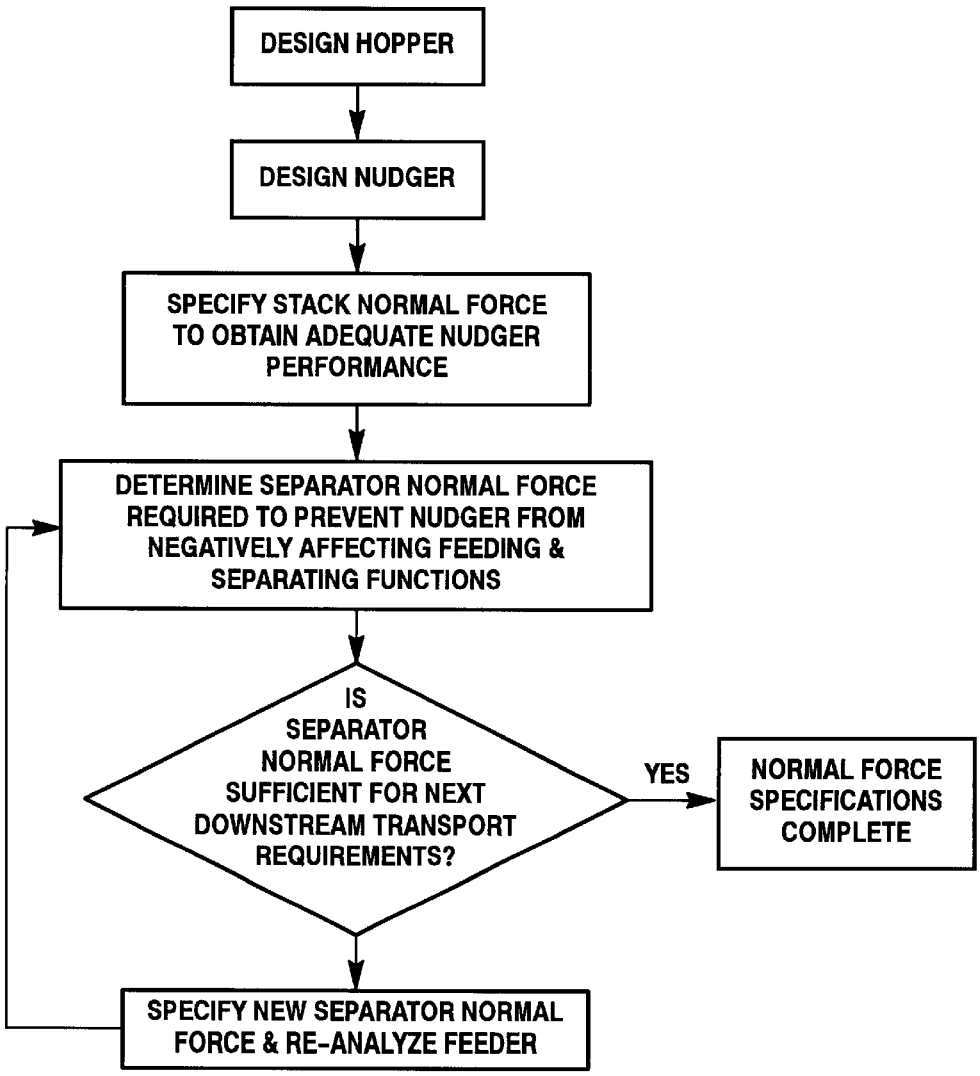
*Figure A3*
*PROCESS FOR DETERMINING REQUIRED NORMAL FORCE*

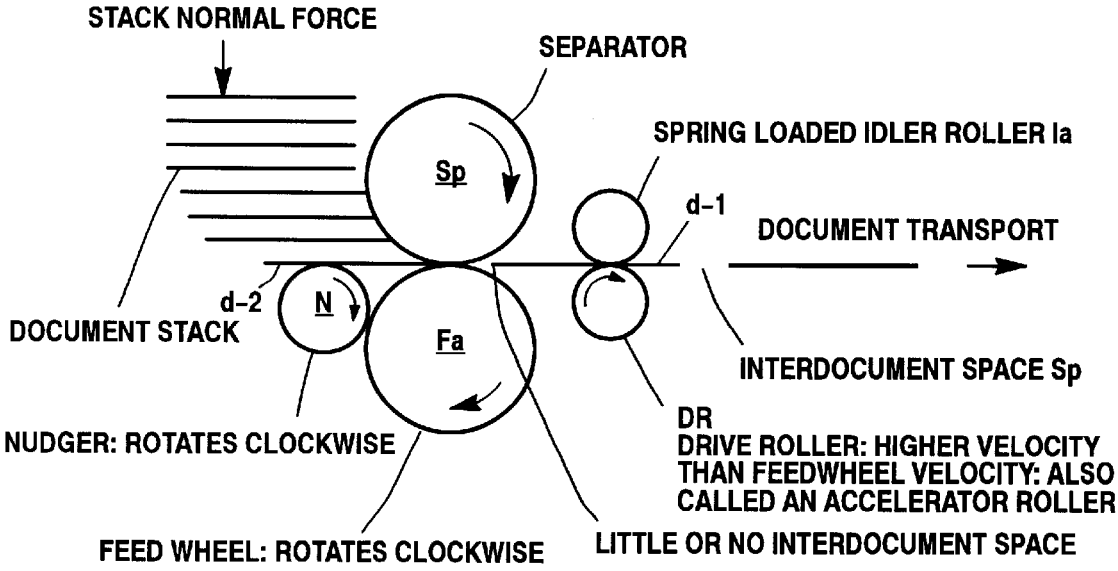
*Figure A4*
*BASIC INTERDOCUMENT SPACE CREATING PROCESS*

FEEDER WITH LARGE PSEUDO-RADIUS

This is a Continuation of my U.S. Provisional Application 60/063,076, filed Oct. 27, 1997 and claims priority therefrom.

This case involves sheet-feeders for feeding sheets singly from a stack.

BACKGROUND

One might postulate a document feeder comprising a feed wheel urging the foremost documents in a first direction, while also using a separator wheel W to cooperate therewith by restraining all following documents (e.g. rotating counter to W to drive documents oppositely) so that only a single document is fed at any one time.

It would often be preferable to make wheel W of large radius to be able to thrust the foremost document along a relatively straight path, a path that is along the document's original stacked-plane or close to it (e.g. note tangent to wheel tends to become so as the wheel radius increases).

If two documents are in the feedwheel/separator nip, there will invariably be some overlap. Hopefully this overlap will be small enough so that the interdocument space creating device can correct it.

To avoid any overlap at all, the feedwheel and separator should work together to prevent more than one document from entering the feedwheel/separator nip. I am not aware that any workers have addressed this issue. Picture a simple model was formulated to investigate the effects of two documents entering the feedwheel/separator nip. FIG. A-1 illustrates this, with sheet stack ST, and foremost sheet d-1, and following sheet d-2. Feed wheel W will be understood as urging d-1 in the "Go" direction (arrow) while non-rotating separator wheel roll R urges d-2 not to follow d-1 (see force F on R)

As a "first-order" approximation, nudger friction force is neglected here, and it is assumed that the documents d-1, d-2 are just slightly in to the nip between W and R, while feedwheel W is trying to drive both documents the rest of the way into the nip.

For this situation, two parameters are calculated. Each is the ratio of the sliding friction force to the non-sliding tangential force between the document and the component. They are called "feed margin" and "separator margin". The higher their values, the more margin there is for successful feeding (allowing sheet d-1 to move into the nip) and separation (preventing sheet d-2 from moving into the nip).

Typical input parameters are suggested in Table I; they might be (all units in the inch-pound-second system):

TABLE I

| | |
|---|---|
| feeder radius: | RF = 1.000 |
| separator radius: | RS = 1.000 |
| doc1 thickness: | T1 = .004 |
| doc2 thickness: | T2 = .004 |
| normal force: | NS = 4.000 |
| force sharing: | C = 1.000 |
| feed/doc1 fric coef: | CFF1 = 1.000 |
| sep/doc2 fric coef: | CFS2 = .800 |
| doc1/doc2 fric coef: | CF12 = .400 |

The results for several runs changing feedwheel and separator radii, areas follows in Table II:

TABLE II

| change to above data | feed margin | separator margin |
|---|---|---|
| None | 1.969 | 2.671 |
| RF = 2.000 | 2.168 | 2.812 |
| RF = 4.000 | 2.309 | 2.922 |
| RF = 8.000 | 2.396 | 2.993 |
| RS = .500 | 2.424 | 3.815 |
| RS = .250 | 2.445 | 6.087 |

Conclusion: Having a large feedwheel radius and/or a small separator-roll radius improves margins for feeding and especially for separating.

FIG. A-2 shows a feeder used to verify the foregoing. Here, a document stack ST is served by a nudge-roll 1-N periodically urging the foremost document into the nip between a feedwheel 1-F and a separator belt SB driven by rollers 1-S and 1-R, to advance this document in direction (Go) of arrow. Here, separator belt velocity is kept relatively low, to greatly favor separation. Here, the velocity of leading edges is slightly higher than the separator belt velocity, giving greater probability to producing "feedchecks". I find that one solves the feedcheck problem by moving the entire separator mechanism toward the front of the machine as far as possible without having to change adjacent parts. This effectively decreases the separator radius due to a subtle position relationship between the feedwheel and the separator mechanism.

FIG. A-2 illustrates this subtle relationship. The feedwheel 1-F contacts the separator belt SB between two rollers. Therefore, the effective radius of the separator near the nip is larger than the roller radius near the nip. The actual value of this radius is a complex function of the elastic properties of the separator belt, the forces applied by the separator mechanism springs, and geometry of the separator mechanism. However, moving the entire separator mechanism to the right (towards the feed-direction) reduces this effective radius at the nip. This is precisely what one should do to improve the feedcheck rate.

Ideally, minimal separator radius is obtained in FIG. A-2 when the entire separator mechanism is moved far enough to the right so that, when a line is drawn through the centerlines of the feedwheel and the belt separator belt drive roller 1-S, the nip lies on this line. This is additional evidence confirming the conclusion arrived at from FIG. A-1.

The reasons for preferring minimal separator radius and maximal feedwheel radius may be argued intuitively. Ideally, the separator should present as blunt a surface as possible to the second and subsequent documents in the stack. This means a "zero radius" object: a rectangular block, would be ideal, though it would be difficult to implement a moving separator under these conditions. The feedwheel wants to be a large radius so as to minimize the vertical component of force that drives against the separator, leaving all the available force for feeding the document. Ideally, a flat (infinite radius) "feedwheel" is desired.

Consequences of Optimal Geometry Conditions

Having a "small-radius" separator is also inimical to long service life. To achieve long separator service life, a belt should be used for the separator to increase surface area, while still being able to maintain small separator radius near the feedwheel/separator nip.

Having a large feedwheel radius is conducive to extended service life. However, large feedwheel radius results in larger drive torque, requiring larger motors. Also, large feedwheel radius results in much, much larger feedwheel inertia. With the trend now towards quickly accelerating and decelerating feedwheels to achieve "constant-separation" feed, interdocument space correction, smart feeders, etc., it might seem that large radius feedwheels are not desirable; or that. Feed margins should be achieved by other means, such as higher feedwheel/document friction coefficient, and driving the nudger faster than the feedwheel.

Normal Forces:

The process for specifying normal forces is rather complex. The basic process that I contemplate is illustrated in FIG. A-3.

As a first order approximation, the value of the separator normal force (e.g. $F_1$, FIG. A-1) does not affect feeding and separation. However, experimental friction measurements with currently used separators and feed tires suggest that the separator normal force should be kept small to increase friction coefficients. Small separator normal forces should also improve the service life of the feed tire and separator, provided there is enough wear to remove contaminants.

But, small separator normal force may also negatively affect the interdocument space creation process. FIG. A-4 illustrates this (e.g. in an array used for high-speed and medium speed sorting).

In FIG. A-4, after document d-1 leaves the feeder, a higher speed, accelerator roller DR accelerates d-1 to a higher speed via the friction force between roller DR and the document. While this acceleration is taking place, and while the next document d-2 is still in the feedwheel/separator nip, an interdocument space (between d-1 and d-2) is created because document d-l has now been accelerated is at a greater velocity. Interdocument space continues to increase until document d-2 leaves the feedwheel/separator nip and is accelerated to the same speed as document d-1.

If the drive force of the accelerator roller DR is greater than the slip force at the feedwheel/separator nip, the accelerator roller DR will pull the document out of the feeder. This could have negative effects on the interdocument space consistency and it can cause excessive wear of the feed tire and separator.

Although the accelerator roller DR is the first roller after the feed wheel (e.g. as in some high and medium speed sorters) it does not need to be the "first". If the interdocument space creation process were placed further downstream, of the feed wheel, it would not be a factor in feeder design.

Complex Model

As artisans will agree, such a feeder is a complex system. A complete analysis is very complex. Because of the statistical nature of friction and document lengths, Monte Carlo simulation is required to perform the analysis. Also, there are many different kinds of document positions that must be considered: two documents in the nip, one document approaching the nip, two documents approaching the nip, etc. A related computer program analysis will contain many "if-then-else" routines.

Novel Feature:

As a salient feature hereof, this invention presents an "effectively-large-radius" (or "pseudo-large" radius) feedwheel in the area of a feedwheel/separator nip, without having to actually use a complete (full circle) large radius feedwheel. In this way, it can improve document feeding reliability without requiring the space, weight, etc. of a complete large radius feedwheel.

What is New or Different:

With such a feature, a feeder belt (e.g. as in FIG. 1) can be provided, to slide over a low friction, large radius block, or the like—as a sheet-feeder, so that the "large radius" is effectively obtained locally at the feedwheel/separator nip. This gives the advantages of large radius feedwheel in a small space and without large inertia.

Thus, it is an object hereof the address (at least some of the aforementioned problems, and to provide the hereincited, and related, advantages and functions. A related object is to provide such in an automatic, large-radius feeder unit of a sheet-sorting machine.

The methods and means discussed herein, will generally be understood as constructed and operating as presently known in the art, except where otherwise specified; with all materials, methods and devices and apparatus herein understood as implemented by known expedients according to present good practice.

BRIEF DESCRIPTION OF THE DRAWINGS

These and other features of advantage of the present invention will be appreciated by workers as they become better understood by reference to the following detailed descriptions of past and present preferred embodiments which should be considered in conjunction with the accompanying drawings, wherein like reference symbols denote like elements.

FIGS. A-1, A-2, A-3, A-4 show models of feeder systems, and methods related to this invention.

While

DETAILED DESCRIPTION OF PREFERRED EMBODIMENTS

Figure 1:
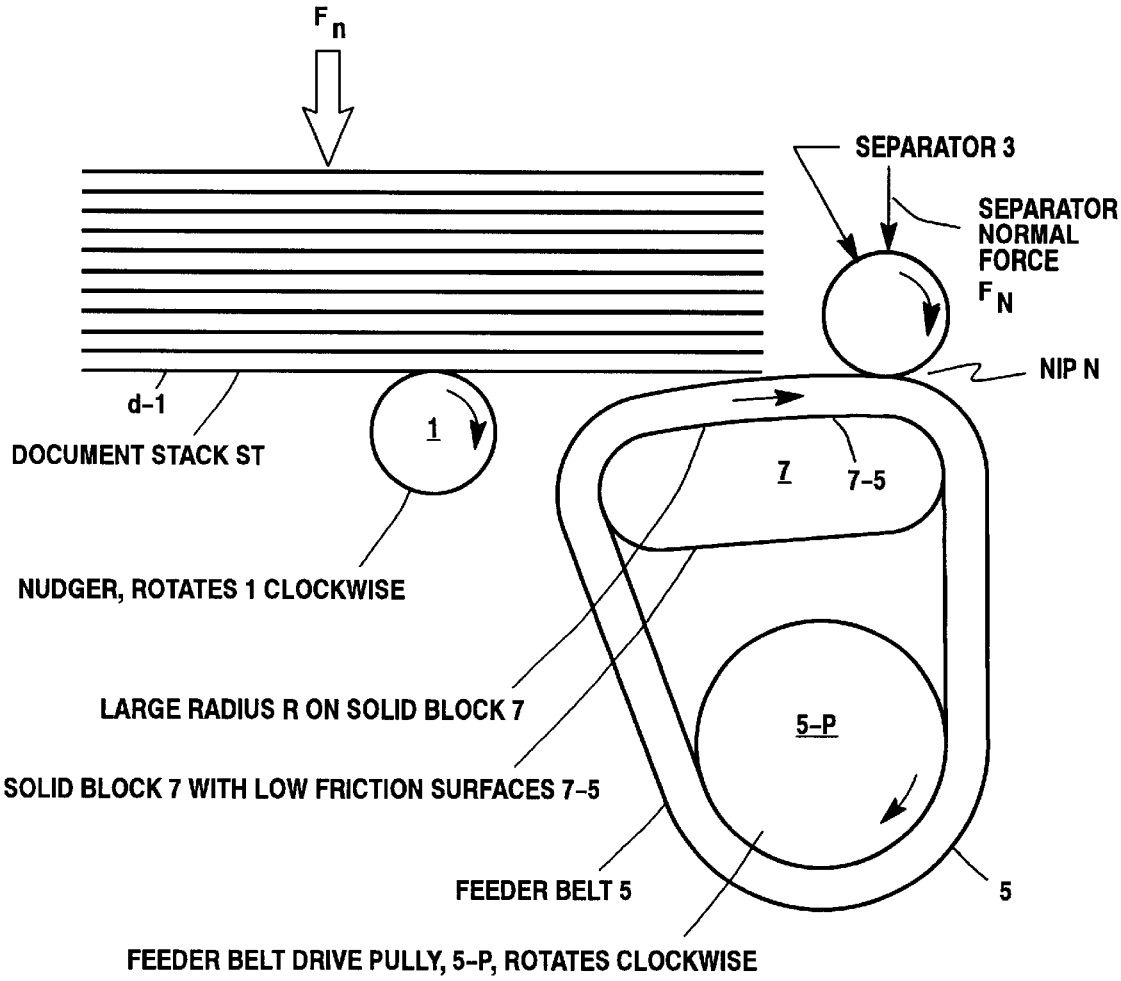
FIG. 1 is a schematic side view of a preferred document-feed embodiment with a "pseudo-large radius" feed array.

FIG. 1 shows, salient elements of a preferred "pseudo-large-radius" document feeder F as will become evident to those practiced in the arts of document feeders,:

Here, a document stack ST is to have its foremost sheet, d-1 periodically pushed towards a nudger 1 by gravity, and/or spring force, and/or a powered device.

Rotating nudger roll 1 is used to push the documents d towards the feedwheel/separator nip n, using friction force created from the normal force Fn that pushes on the document stack ST.

A separator 3 is used to separate the second and subsequent documents d from d-1 in stack ST and inhibit them from being fed with document d-1.

Preferably, a separator normal force Fs-n is also supplied on 3, e.g. by a spring, to create friction force between separator wheel 3 and the document, as the document emerges from the nip n, between it and a feed-belt 5, as the document is fed.

Salient features in FIG. 1 are the solid block 7 with low friction surfaces 7-S, including a slight-radiused top face, and the feeder belt 5 sliding, with minimal friction, over block 7, plus a feeder belt drive pulley 5-P.

The block 7 has a large radius R (e.g. a flat or large-radius surface) in the vicinity of the feeder belt/separator nip n. Feeder belt 5 is wrapped drivenly around the drive pulley 5-P, and idlers I-1, I-2, in intimate contact with the upper, large-radius, surface 7-S of the solid block. This forces the radius of the outside of the feeder belt to have a slightly larger radius than the solid block, by the thickness of the feeder belt. The feeder belt 5 can slide easily across block 7 because the solid block is, preferably, made of low friction material such as Teflon or polyethylene, or is coated therewith.

The feeder belt 5 is continuous, and wraps drivenly around the feeder belt drive pulley 5-P, with high friction between it and the feeder belt, so that the feeder belt will not slip thereon. This can preferably be accomplished with a pulley of high friction elastomer such as polyisoprene (natural or synthetic rubber) or polyurethane.

Feeder belt 5 is kept in continual contact with the surface of block 7 (e.g. via tension in the belt). This tension may be supplied by many means known to those practiced in the arts of driving belts: spring loaded idler pulleys, spring loaded drive pulleys, or stretching an elastic belt over the solid block and drive pulley. The feeder belt may be elastic, since it is typically made of an elastomer to achieve high friction properties when sliding against documents.

Because the feeder belt 5 slides over the solid block 7 in the vicinity of the feeder belt/separator nip n, and because the solid block has a large radius R near the feeder belt/separator nip; the outside surface of feeder belt 5 forms a large radius at the entrance to the feeder belt/separator nip n. This moving surface is used to feed the document as indicated by the "Go" arrow.

As described below, this large radius imparts improved feeding reliability. Since this "large-radius" need occur only locally (just before the feeder belt/separator nip) use of such a block 7 minimizes space and inertia, avoiding a complete heavy cylindrical roller of large radius, and makes a simpler, more compact array. Thus, the belt and block form a novel feeder means with a "pseudo-large" radius.

Figure 2:
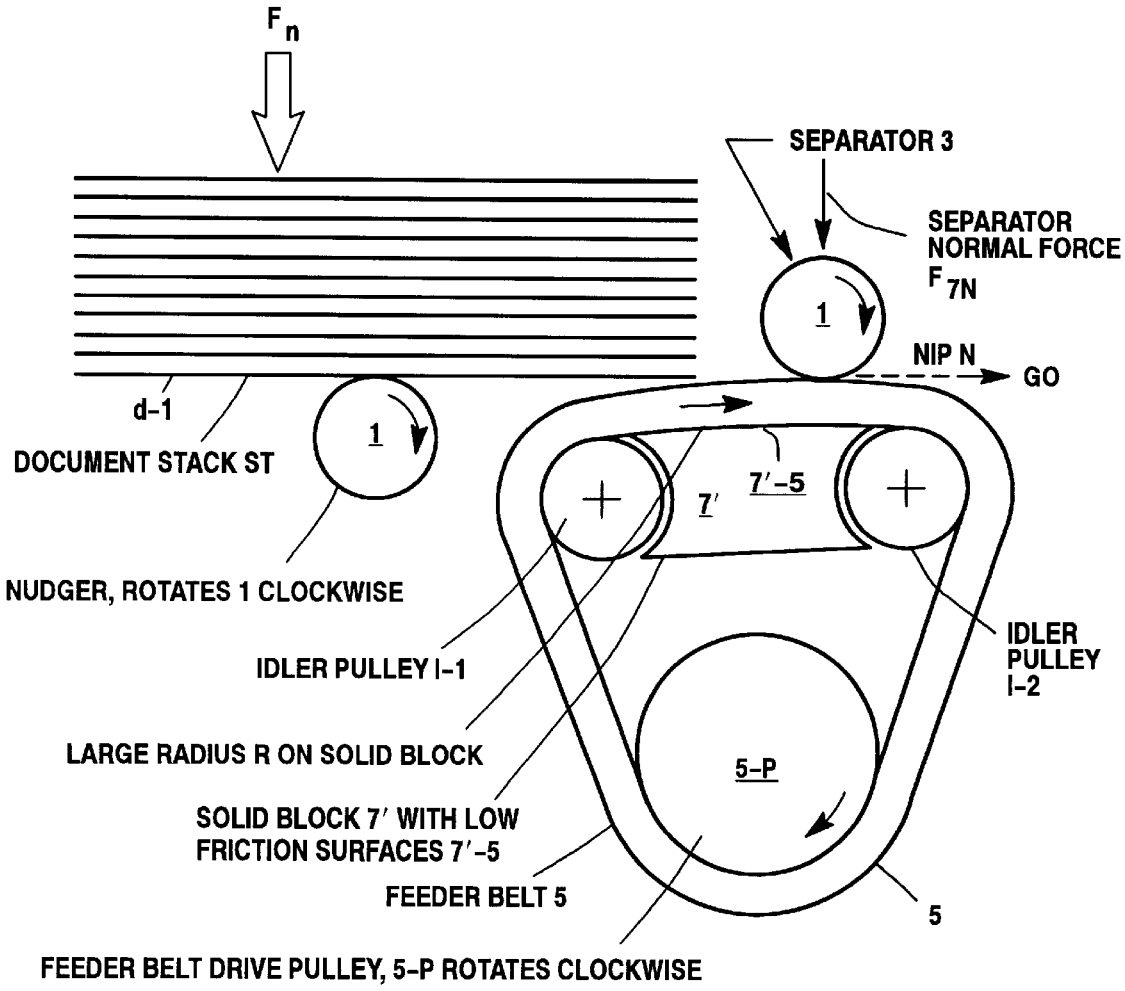
FIG. 2 is a like showing of another such embodiment modified to include roller means flanking a block.

FIG. 2 (same as FIG. 1 except as noted) shows an alternative construction, modified to further reduce the friction between the solid block and the inside of the feeder belt. The two small radii surfaces on either side of the solid block in FIG. 1 are replaced by idler pulleys I-1, I-2 allowed to freely rotate about their centers. The solid block 7 still maintains, a large radius in the vicinity of the feeder belt/separator nip, n, retaining the document feeding properties. Because of the greatly reduced feeder belt wrap around the solid block, there is much less friction between the feeder belt and the solid block. This results in less torque required to drive the feeder belt drive pulley. It also results in less likelihood for slip to occur between the feeder belt 5 and its drive pulley 5-P.

Because the feeder belt is generally made from an elastomer, teeth can be molded on the inside surface of the feeder belt. This would enable toothed pulleys to be used for the feeder belt drive and idler pulleys. Such toothed belt and pulley drive systems are well known to those practiced in the art of belt drive systems. The toothed belt and drive pulley has the advantage of not slipping.

The toothed belt and drive pulley systems preferred are in common use and have significant surface area at the tips of their teeth. That is, the teeth are trapezoidal shaped. The tips of these teeth would be the inner-most surface of the feeder belt. It is common practice to put a low friction coating, such as nylon, on the surfaces of the belt's teeth to promote smooth engagement and disengagement with pulley grooves. In this invention, this low friction coating also serves to minimize friction between the feeder belt and the solid block.

Alternatively, one can replace the block 7 and pulleys I-1, I-2 with a row of small pulleys.

Figure 3:
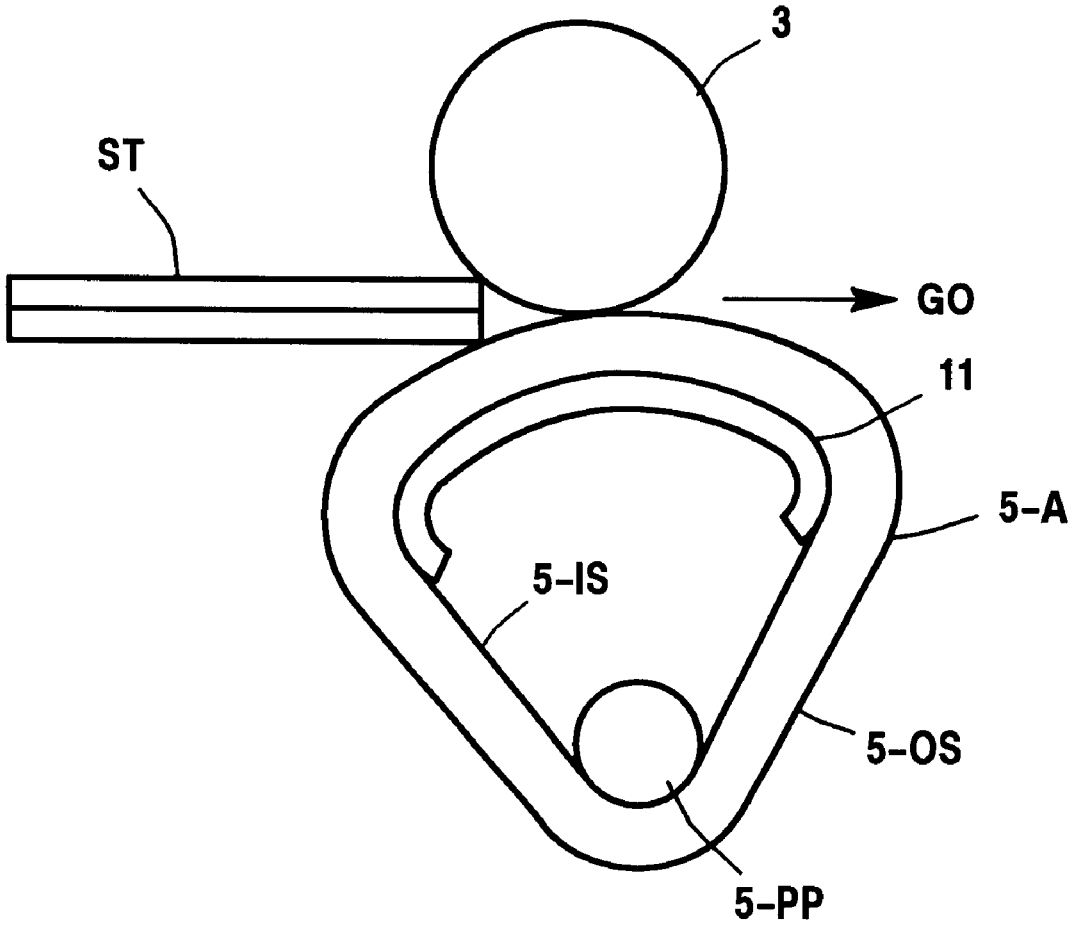
FIG. 3 is another like showing of yet another embodiment substituting a curved plate for such a block.

Alternate construction (FIG. 3).

FIG. 3 shows a similar array with like functions, except that block 7 is replaced by a curved plate 11, belt 5 is replaced by a large-radius feed-tire 5-A driven by small-radius pulley 5-PP. The tire 5-A is preferably made of an elastomeric material, with a high-friction outer surface 5-OS. The inner-surface 5-IS of tire 5A may be coated with low-friction material (pref. teflon) to slide easily over plate 11, but is made to drivingly engage its drive pulley 5-PP via frictional elements attached to the feed belt drive pulley 5-PP.

The foregoing (and other, like) feeder embodiments will be seen as advantageously minimizing cost, assembly time, noise, etc., and as better accommodating various document sizes, while quickly reacting and steering successive documents to an optimal position in a pocket.

Conclusion

It will be understood that the preferred embodiments described herein are only exemplary, and that the invention is capable of many modifications and variations in construction, arrangement and use without departing from the spirit of the invention.

Since modifications of the invention are possible, for example the means and methods disclosed herein are also applicable to other feed arrangements, as well as to other related stacking arrays; and it will be understood that the present invention is also applicable for enhancing other related sheet-advance arrangements (e.g., document sorters, mail sorters, copies, page feeders for printers, punch card sorters, envelope stuffing machines, money feeders and transports in automatic teller machines).

Examples given above of other possible variations of this invention are merely illustrative. Accordingly, the present invention is to be considered as including all possible modifications and variations within the scope of the invention as defined by and set forth in the appended claims.

What is claimed is:

1. A document feed arrangement comprising, a nip between a feeder and a separator where sheets in a stack are urged, singly into said nip and advanced therebeyond by said feeder, a rotating nudger for urging said sheets into said nip, said nudger having an open space separation from said nip and said feeder, said nudger disposed adjacent the end sheet in said stack and arranged to periodically thrust said end sheet across said separation into said nip and as soon as said end sheets leaves said nudger said nudger immediately contacts the next-to-the-end sheet in said stack and begins to thrust it forward, said feeder having a surface defined by a large radius, less than an infinity radius, at the point of said nip so that the surface of said feeder bends away from said nip in the direction from which said sheets are fed, said feeder made up of a small section of a moving belt with said small section being curved to define a large radius, less than an infinity radius, at the point of said nip, said moving curved belt reducing the size of said feeder required to obtain a large radius at the point of said nip, said feeder surface having a greater friction with said sheets than said nudger, said feeder advancing said end document from said stack through said nip without simultaneously advancing said next-to-the-end document, said separator having a surface defined by a smaller radius than said large radius, which is less than infinity, of said feeder, said separator for restraining the remaining documents of said stack.

2. The arrangement of claim 1, wherein said curved belt is driven by an associated drive across a block over which said belt is advanced, said block disposed opposite said separator and positioned so that said moving belt creates said nip into which each document is fed.

3. The arrangement of claim 2, wherein said belt comprises a belt having a frictional outer surface for engaging and advancing said documents.

4. The invention of claim 3 wherein said block has a low-friction surface across which said belt is pulled, said block shaped to provide said small section of said moving belt with a curve to define a large radius.

5. The arrangement of claim 4, wherein said belt's outer surface is made elastomeric and arranged to engage said separator with a slight force to create said document-advancing nip.

6. The invention of claim 5, wherein said curved belt slopes away from said nip.

7. The arrangement of claim 6, wherein said belt drive comprises a rotating pulley.

8. The arrangement of claim 7, wherein said separator comprises a stationary roll.

9. The arrangement of claim 7, wherein said separator comprises a roller rotating counter to said belt.

10. The arrangement of claim 7, wherein said separator comprises a roller rotating in the same direction as said belt but at a slower speed.

11. The arrangement of claim 2, wherein said block is relieved to receive a pulley engaging said belt to pull it across the low-friction surface of said block .

12. The arrangement of claim 1, wherein said curved belt is driven by an associated drive across a series of rollers forming a curve over which said belt is advanced, said curved series of rollers disposed opposite said separator and positioned so that said moving belt creates said nip into which each document is fed.

13. The apparatus of claim 1 wherein said curved belt is driven by an associated drive across a block over which said belt is advanced, said block disposed opposite said separator and positioned so that said moving belt creates said nip into which each sheet is fed.

14. A method for feeding documents comprising, creating a nip between a feeder and a separator, where documents in a stack are urged singly into said nip and advanced there beyond by said feeder, urging one or more said documents randomly to said nip by a rotating nudger, to form a stack of one or more documents adjacent said nip, said nudger having an open space separation from said nip and said feeder, said nudger disposed adjacent the end document in said stack and arranged to periodically thrust said end document across said separation into said nip and as soon as said end document leaves said nudger, said nudger immediately contacts the next-to-the-end document in said stack and begins to thrust it forward, said feeder advancing said end document from said stack through said nip without simultaneously advancing a second document, said feeder surface defined by a large radius, less than an infinity radius, at the point of said nip so that the surface of said feeder bends away from said nip in the direction from which said sheets are fed, said feeder made up of a small section of a moving belt with said small section being curved to define a large radius, less than an infinity radius, at the point of said nip, said moving curved belt reducing the size of said feeder required to obtain a large radius at the point of said nip, said feeder acting with greater friction on said sheet than the friction on said nudger on said sheets, restraining the remaining documents of said stack with said separator, said separator surface defined by a smaller radius than said large radius, which is less than infinity, of said feeder.

15. The method of claim 14 wherein said curved belt is driven by an associated drive across a block over which said belt is advanced, said block disposed opposite said separator and positioned so that said moving belt creates said nip into which each document is fed.

16. The method of claim 15 wherein said documents are engaged and advanced by said belt having a frictional outer surface.

17. The method of claim 16 wherein said belt is pulled across said block having a low-friction surface.

18. The method of claim 17 wherein said belts outer surface is elastromeric and engages said separator with a slight force to create said document-advancing nip.

19. The method of claim 18 wherein said curved belt slopes away from said nip.

20. The method of claim 19 wherein said belt drive comprises a rotating pulley.

21. The method of claim 19, wherein said separator comprises a stationary roller.

22. The method of claim 19, wherein said separator comprises a roller rotating counter to said belt.

23. The method of claim 19, wherein said separator comprises a roller rotating in the same direction but slower than said belt.

24. The method of claim 15 wherein said belt comprises a web entrained about a web drive so as to be pulled across said block.

25. The method of claim 15 wherein said block is relieved to receive a pulley engaging said belt to pull it across the low-friction surface of said block means.

26. The method of claim 14 wherein said curved belt is driven by an associated drive across a series of rollers forming a curve over which said belt is advanced, said curved series of rollers disposed opposite said separator and positioned so that said moving belt creates said nip into which each document is fed.

27. The method of claim 14 wherein said belt is formed and disposed to simulate a sector of a large-radius drive roller, so that a large-radius is obtained in the region of said nip, yet without having to use a large-radius roll there.

* * * * *